United States Patent [19]

May

[11] 4,168,646

[45] * Sep. 25, 1979

[54] ELECTRO-ACOUSTICALLY AMPLIFIED DRUM

[76] Inventor: Randall L. May, 8312 Seaport Dr., Huntington Beach, Calif. 92646

[ * ] Notice: The portion of the term of this patent subsequent to Sep. 20, 1994, has been disclaimed.

[21] Appl. No.: 927,543

[22] Filed: Jul. 24, 1978

[51] Int. Cl.[2] ..... G10H 3/00; G10D 13/02

[52] U.S. Cl. ..... 84/1.14; 84/DIG. 12; 84/411 R

[58] Field of Search ..... 84/1.14, 1.15, 411 R–419, 84/DIG. 12

[56] References Cited

U.S. PATENT DOCUMENTS

| | | | |
|---|---|---|---|
| 3,008,367 | 11/1961 | Parsons | 84/1.15 X |
| 3,192,304 | 6/1965 | Rizzutti | 84/DIG. 12 X |
| 3,509,264 | 4/1970 | Green | 84/1.15 |
| 3,549,775 | 12/1970 | Kaminsky | 84/DIG. 12 X |
| 3,551,580 | 12/1970 | Glenn et al. | 84/DIG. 12 X |
| 3,553,339 | 1/1971 | Dominguez et al. | 84/1.15 |
| 3,621,749 | 11/1971 | Aluisi | 84/411 |
| 3,725,561 | 4/1973 | Paul | 84/1.15 |
| 3,956,959 | 5/1976 | Ebihara et al. | 84/1.15 |
| 4,048,895 | 9/1977 | May | 84/411 R X |

*Primary Examiner*—Ulysses Weldon
*Attorney, Agent, or Firm*—Neal J. Mosely

[57] ABSTRACT

An electro-acoustically amplified drum consists of a hollow drum shell having at least one open end, a drum head spaced from the open end of said drum shell and supported thereon, and a microphone supported on and positioned within said drum shell and adapted to be connected to an external amplifier and speaker. The microphone is preferably supported in a position spaced from the wall of the drum shell to receive acoustical impulses separately from the drum head and the drum shell.

The drum head may be a separate drum head supported on the drum shell in a fixed position or adjustable in relation to the spacing from the open end of the drum shell. Alternatively, the drum head may be supported on a drum shell having a plurality of apertures adjacent to the point of support, said apertures providing acoustical openings separating the drum head from the remainder of the shell which functions as a drum shell resonator.

16 Claims, 10 Drawing Figures

ELECTRO-ACOUSTICALLY AMPLIFIED DRUM

BACKGROUND OF THE INVENTION

1. Field of the Invention

This invention relates to new and useful improvements in drums or drum assemblies and more particularly to a drum or drum assembly provided with electrical amplification by means of a microphone supported within the drum shell.

2. Brief Description of the Prior Art

A conventional drum consists of a hollow drum shell having one or more drum heads held in place by head hoops. Conventional drums are usually not tunable except in a very narrow range by adjustment of the head loop. Likewise, conventional drums have not been electrically amplified in any satisfactory manner.

The placing of an electric microphone adjacent to the drum head of a conventional drum has not proved satisfactory since only the vibrating sound from the drum head is amplified and there is very little amplification of the resonant components of the sound. The placing of an electric microphone inside a conventional drum has resulted in the amplification of a mixture of vibratory sounds which amplification has not been musically acceptable.

Green U.S. Pat. No. 3,509,264 discloses one attempt to amplify percussion instruments, including drums. In this patent, an electric pickup is cemented to the skin of a drum head and vibrates adjacent to a magnet which constitutes the remainder of the pickup and is secured to a fixed part of the drum shell. An arrangement of this type may produce an amplification of vibrations of the drum skin but does not produce an amplification acoustically of the sounds originating from the drum skin and by resonance from the drum shell.

Dominguez and Peake U.S. Pat. No. 3,553,339 discloses a drum-like instrument in which the diaphragm or skin carries one part of an electrical pickup and another part of the electrical pickup is supported on the shell. This device provides for amplification of the vibrations of the diaphragm or skin of the drum head but does not provide for amplification of the acoustical sound mixture produced by the drum.

Ebihara and Serizawa U.S. Pat. No. 3,956,959 discloses a drum in which the diaphragm or skin of the drum head carries a magnet which moves relative to a sensing element. This arrangement provides only for amplification of the vibrations from the drum head and not of the mixture of acoustical sounds produced by the drum.

SUMMARY OF THE INVENTION

This invention comprises a new and improved drum or drum assembly provided with electro-acoustical amplification.

It is an object of this invention to provide new and improved drum or drum assembly including means for amplification of the vibrations produced by the drum head and the resonant components produced by the drum shell.

Another object of this invention is to provide an improved tunable drum assembly including means for electro-acoustical amplification.

A feature of this invention is the provision of an improved drum assembly having a drum head spaced from a hollow drum shell and having a microphone supported within said shell and spaced from said drum head and adapted for connection to an external amplifier.

Another feature of this invention is the provision of an improved drum or drum assembly having a tunable drum head supported on and spaced from a drum shell and having a microphone supported within said shell and spaced from said drum head and adapted for connection to an external amplifier.

Other objects and features of this invention will become apparent from time to time throughout the specification and claims as here and after related.

DESCRIPTION OF THE PREFERRED EMBODIMENTS

Figure 1:
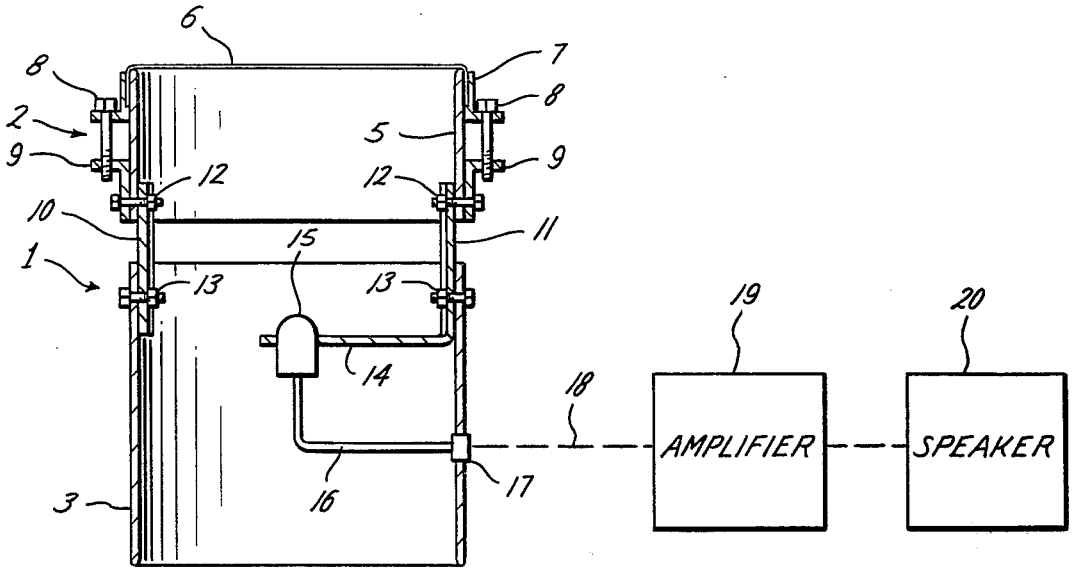
FIG. 1 is a view in longitudinal section of a drum assembly provided with a microphone and external amplification.

In the drawings, there is shown the combination of a drum head supported on and spaced from the open end of a drum shell and provided with a microphone and amplifier system for amplification of the acoustical output of the drum. In FIG. 1, the drum assembly 1 consists of drum head 2 supported on the open end of drum shell 3. The lower end of drum shell 3 may be open, as shown or may be provided with an optional lower drum head 4 indicated schematically in a modified view shown in FIG. 1A, which may be fixed or tunable in the same manner as the upper drum head in the embodiment shown in FIG. 4.

Drum head 2 consists of supporting cylinder 5 which is relatively short in length in relation to drum shell 3. Cylinder 5 has a drum skin or diaphragm fixed held in position by tensioning hoop 7. Tensioning hoop 7 is secured by a plurality of adjusting screws or bolts 8 which are threaded into member 9 which is secured on the lower portion of cylinder 5. Adjustment of bolts or screws 8 varies the tension in the drum skin or diaphragm 6 in drum head 2. Drum head 2 is secured to the open end of drum shell 3 by a plurality of brackets 10 and 11 secured in place by screws or other supporting members 12 and 13.

In FIG. 1, bracket 11 is also provided with a laterally extending supporting portion 14 in which there is supported microphone 15. Microphone 15 is connected by electrical lead 16 to jack 17 which is supported in the wall of drum shell 3. The jack 17 is of conventional form and may be connected, as indicated by dotted line 18, to amplifier 19 which is in turn connected to speaker 20.

It should be noted, in this embodiment of the invention, that drum head 2 is spaced longitudinally from the open end of drum shell 3. This allows the drum assembly to breathe while being played. It is necessary for satisfactory amplification of the drum sounds that the drum head be spaced a substantial distance from the open end of drum shell 3. It is also necessary for the microphone 15 to be supported in the interior of drum shell 3 away from the wall of the drum shell and spaced from drum head 2. This arrangement permits microphone 15 to pick up the direct sound from percussive impact on drum skin or diaphragm 6 and also reflected sound resonating from the walls of drum shell 3. This combination of sounds is amplified by amplifier 19 and heard over speaker 20. This arrangement results in a uniform amplification of both the direct sound produced by impact or attack of the drum stick on drum skin or diaphragm 16 and of the resonant features of the sound produced within drum shell 3. This type of amplification is not possible if the drum head 2 is not spaced appreciably from drum shell 3.

ANOTHER EMBODIMENT

Figure 2:
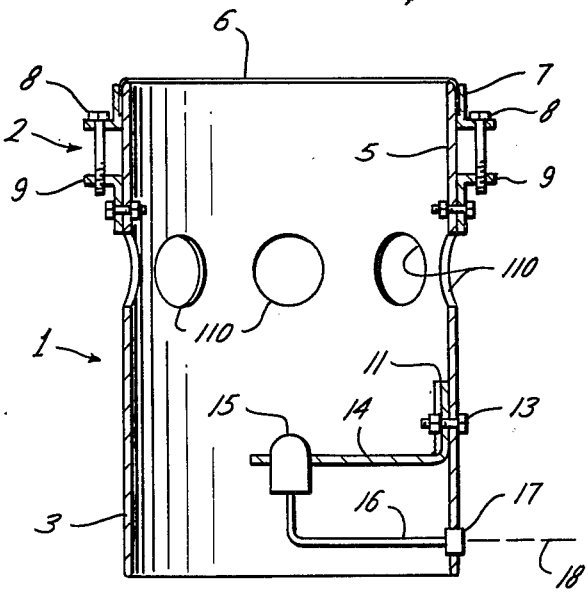
FIG. 2 is a view in longitudinal section of another embodiment of the amplified drum assembly of FIG. 1.
Figure 2A:
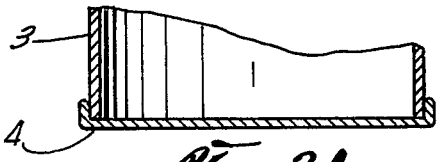
FIG. 2A is a fragmentary view, in section, showing the bottom portion of FIG. 2 with a drum head positioned thereon.

In FIG. 2, there is shown another embodiment of the invention described above in which the supporting cylinder of the drum head is supported as a part of the drum shell. In this embodiment, drum assembly 1 consists of drum head 2 which is supported on drum shell 3. Drum head 2 is integral with drum shell 3 but is supported a substantial distance above the operative upper end of the drum shell. As in FIG. 1, drum shell 3 may be open or may be closed by an optional lower drum head 4 as shown in FIG. 2A.

Drum head 2 includes upper cylindrical portion 5 on which drum skin or diaphragm 6 is supported. Drum skin or diaphragm 6 is held in place by tensioning hoop 7 through which bolts or screws 8 extend into supporting member 9.

The drum assembly is provided with a plurality of large holes or apertures 110 which are preferable of a size such that the portion of the cylinder between the holes is only the amount required to secure the cylindrical portion 5 of drum head 2 on drum shell 3. The portion of the cylinder between holes or apertures 110 corresponds in function to the supporting brackets 10 and 11 in FIG. 1.

In this embodiment, bracket 11 is provided, as in FIG. 1, to support microphone 15 on drum shell 3.

This embodiment functions substantially the same as that shown and described in FIG. 1. The microphone 15 is supported within drum shell 3 well below the drum head 2 and spaced from the walls of the drum shell. Microphone 15 is positioned to pick up the sound of percussive impact or attack by the drum stick on drum skin or diaphragm 6 and also the sounds which are produced by resonating from the walls of drum shell 3. The holes or apertures 110 provide the function of spacing the drum head from the drum shell.

Figure 3:
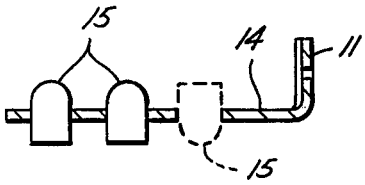
FIG. 3 is a detail view, partly in section, of a bracket for supporting a plurality of microphones within a drum shell in accordance with this invention.

It should be noted that in either of the embodiments shown in FIGS. 1 and 2 the microphone 15 may be positioned in any desired direction. In FIG. 3, there is shown an embodiment in which a plurality of microphones 15 are used and in which one or more of the microphones may be positioned in a different direction from the others. This arrangement may be used with microphones of differing sensitivity to different acoustical ranges. Thus, the use of a plurality of microphones makes possible the amplification of different aspects of the sound produced by the drum in a manner which is not possible by merely amplifying the external output of the drum.

THE AMPLIFIED TUNABLE DRUM

Figure 4:
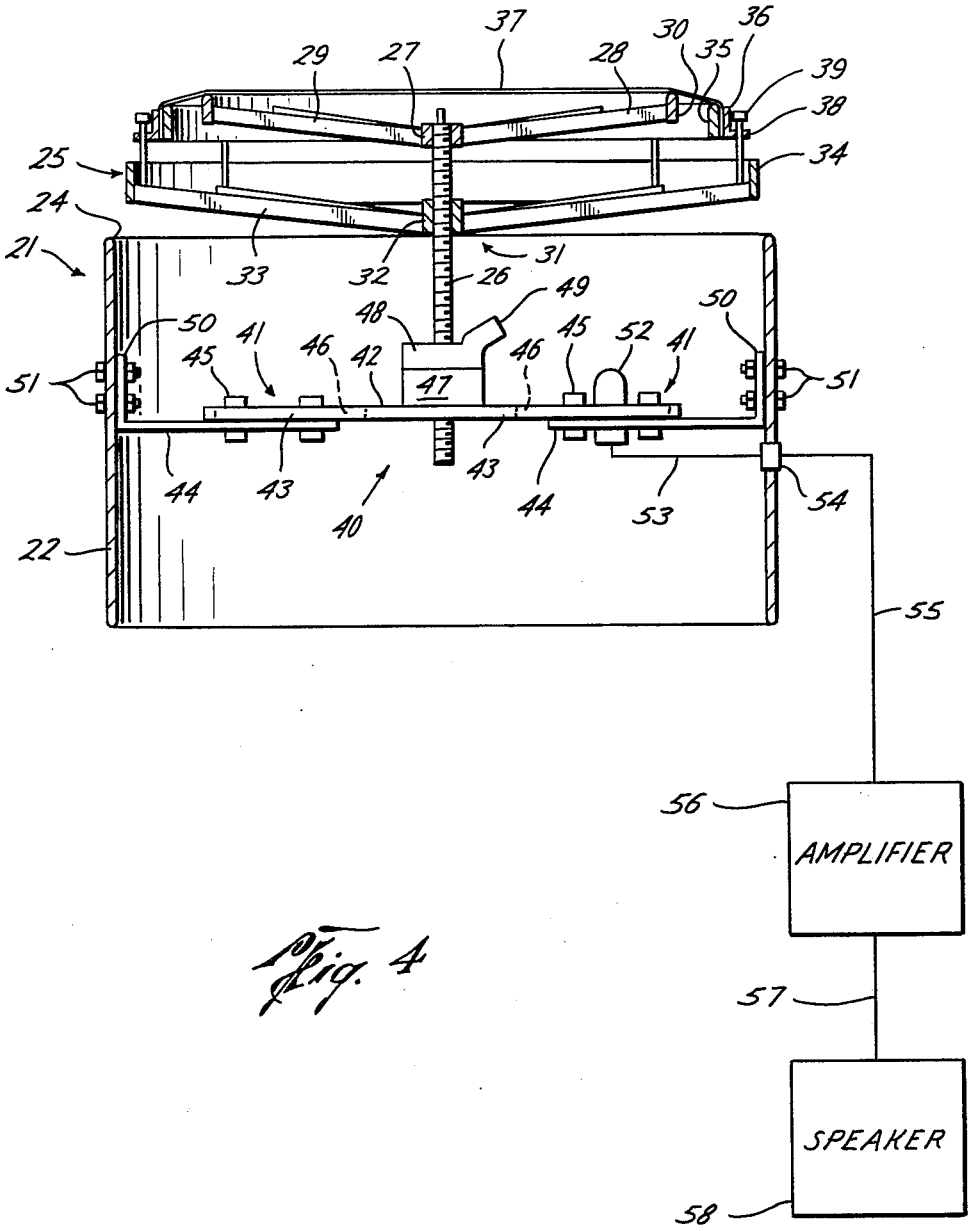
FIG. 4 is a view in longitudinal section of a drum shell provided with a tunable drum head and microphone for external amplification.

In FIG. 4, there is shown an adjustable pitch drum of the type disclosed and claimed by applicant in U.S. Pat. No. 4,048,895, modified in accordance with this invention. The invention shown in FIG. 4 comprises a combination of an adjustable pitch drum with a conventional drum shell and having a microphone supported within the drum shell for amplification of the drum sounds. As in the embodiments shown in FIGS. 1 and 2, the drum head is spaced from the end of the drum shell to permit the drum assembly to breathe during operation and thus provide for the amplification of both the sound produced by impact or attack of the drum stick on the drum head and the sound produced by resonance within the drum shell.

Figure 1A:
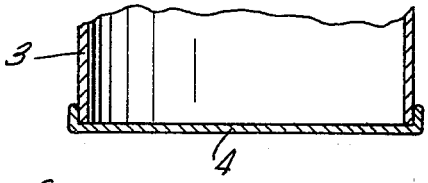
FIG. 1A is a fragmentary view, in section, showing the bottom portion of FIG. 1 with a drum head positioned thereon.

In FIG. 4, the drum assembly 21 includes a conventional drum shell 22 and may optionally include a lower drum head (which may be fixed or turnable) as in FIG. 1A or FIG. 2A. The lower end of the drum shell may be open or may be provided with a drum head. The upper end of the drum shell 22 is open and does not have the conventional drum head stretched thereon.

At the open end 24 of drum shell 22 there is supported an adjustable pitch drum structure, generally designated 25 of the type known as a RotoTom. The RotoTom 25 consists of a threaded rod 26 which carries a tensioning spider at its upper end comprising a central support 27 having a plurality of legs 28 and 29 which extend to and are integral with a tensioning hoop 30. The tensioning spider is held in a fixed position at the end of supporting rod 26.

A second spider 31 is supported on rod 26 and consists of a central threaded hub 32 having a plurality of supporting arms 33 extending outward to and being integral with a first supporting hoop 34. A second supporting hoop 35 is spaced from spider 31 and fits inside clamping hoop 36. Hoops 35 and 36 secure the periphery of the skin or diaphragm 37 of drum head 35 tightly. Hoop 36 has a lower flange 38 through which extend a plurality of bolts 39 which are threadedly mounted in bosses on supporting hoop 34 of spider 31.

Hoop 34 may be rotated to turn support 32 on threaded shaft 26 to vary the position of spider 31 relative to the tensioning hoop 30. Tensioning hoop 30 is maintained in a position abutting the skin or diaphragm 37 of drum head 25 and rotation of supporting hoop 34 moves the same on shaft 26 to adjust the tension of the drum skin or diaphragm for tuning. This adjustment is operable to tune over a range of up to several octaves. The structure, so far described, is that of a commercially available RotoTom.

In this apparatus there is provided a supporting spider 40 having a plurality of legs 41 which are secured to and integral with supporting plate 42. The legs 41 are preferably formed of two parts 43 and 44 which are adjustably secured together by screws 45 positioned in slots 46. The legs 43 and 44 are therefore telescoping in structure to permit the tunable drum head to be installed in drum shells of various diameters. Spider 40 has a central supporting member or boss 47 which is internally threaded to receive threaded rod 26. A lock nut 48 is positioned on rod 26 and may be tightened against boss 47 to prevent rod 26 from turning. Lock nut 48 has a tubular side projection 49 which permits rotation of the lock nut by insertion of any suitable actuating rod, which may be a drum stick.

In the apparatus shown in FIG. 4, the spider 40 has four legs 41, only two of which are seen. The other two legs 41 extend normal to the plane of the drawing. The outer end of members 44, which are a part of legs 41, are bent upward as indicated at 50 to provide a flange through which screws 51 are positioned to hold spider 40 within drum shell 22.

In FIG. 4, a microphone 52 is supported by one or more of the spider legs 41 or by a supporting plate (not shown) supported between spider legs 41. Microphone 52 is connected by an electric lead 53 to jack 54 which is positioned in the wall of drum shell 22. Jack 54 is adapted to receive electric lead 55 from amplifier 56 which is connected by lead 57 to speaker 58.

When the apparatus is assembled, the support spider 40 is secured in place by screws 51 which extends through flanges 50. Next, the supporting rod 36 has lock nut 48 threaded thereon. Supporting rod 26 is then threaded into the threaded supporting boss 47 on support spider 40. The RotoTom shaft or supporting rod 26 is threaded into threaded support or boss 47 through the desired position relative to drum shell 22 and lock nut 48 is tightened to secure shaft 26 in a fixed position.

When the drum is assembled in this manner is has the appearance of a conventional drum but provides the action and tone of a RotoTom. Supporting hoop 34 may be rotated to vary the pitch of drum head 25 and can provide tuning of the drum skin or diaphragm 37 over a wide range. When lock nut 48 is loosened, rotation of supporting hoop 34 will cause shaft or rod 26 to be threaded into or out of threaded supporting boss 47. This will cause the RotoTom to be moved upwardly or downwardly relative to the open end 24 of drum shell 22 and provide an additional variation in tone. The movement of the RotoTom relative to the open end of drum shell 22 provides for variation in resonant tone as well as the tuning which may be effected by rotation of the RotoTom on its supporting shaft or rod 26. When the RotoTom is positioned relative to supporting spider 40 at a point providing the desired resonant tone, lock nut 48 is turned to lock the shaft or rod 26 in a fixed position.

As in the embodiments shown in FIGS. 1 and 2, the microphone 52 (which provides the same function as microphone 15) is effective to amplify the acoustical output of the drum. The positioning of microphone 52 within drum shell 22 away from the walls of the drum shell and away from the tunable drum head 25 results in microphone 52 picking up the sound produced by impact or attack of the drum stick on drum skin or diaphragm 37 and the sound resonating from the walls of drum shell 22. It is this mixture of sound which is amplified by amplifier 56 and speaker 58. This arrangement makes it possible to provide the drum assembly which is tunable and provides for the amplification of the sound produced by the drum head and the resonant drum shell.

OTHER DRUM SHELL CONFIGURATIONS

Figure 5:
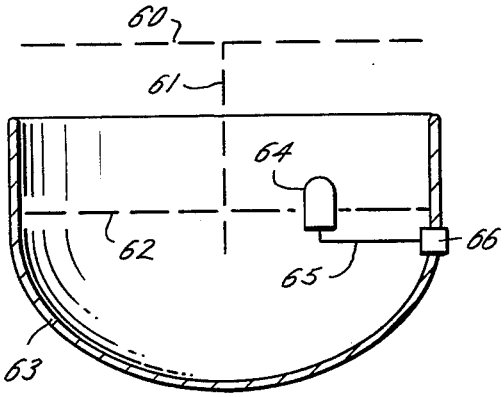
FIG. 5 is a view, partially schematic, in section, illustrating the invention as applied to a timpani drum shell.
Figure 6:
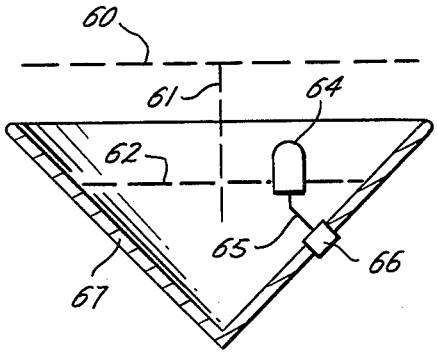
FIG. 6 is a view illustrating the invention as applied to a conical drum shell.
Figure 7:
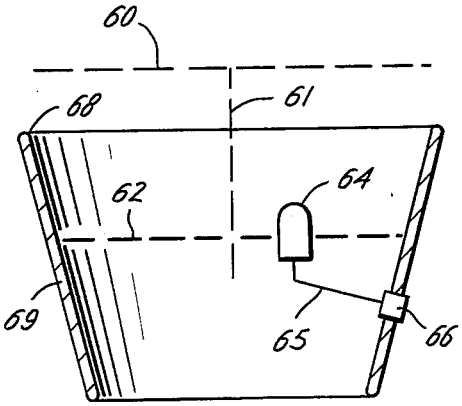
FIG. 7 is a view illustrating the invention as applied to the large end of a frusto-conical drum shell.

In FIGS. 5 to 10 the invention is illustrated with the drum head supported on a variety of hollow drum shells of various shapes and provided with a microphone and jack for connection to an external amplifier system. In FIG. 5, the drum head and its supporting structure is shown schematically. Drum head 60 provided with vertical support 61 and supporting spider 62 is supported in a timpani drum shell 63. Microphone 64 is supported within drum shell 63 and connected by electric lead 65 to jack 66 for connection to an amplifier and speaker. In FIG. 6, the arrangement of FIG. 5 is shown as applied to a drum shell 67 of conical shape. In FIG. 7, the arrangement of FIG. 5 is shown with the drum head 60 supported above the larger end 68 of frusto-conical drum shell 69, which may optionally have a lower drum head, as in FIG. 1A or FIG. 2A.

Figure 8:
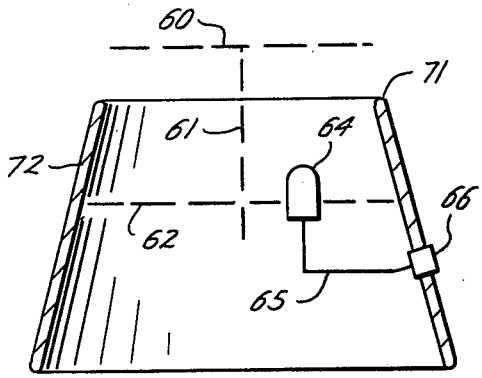
FIG. 8 is a view illustrating the invention as applied to the small end of a frusto-conical drum shell.
Figure 9:
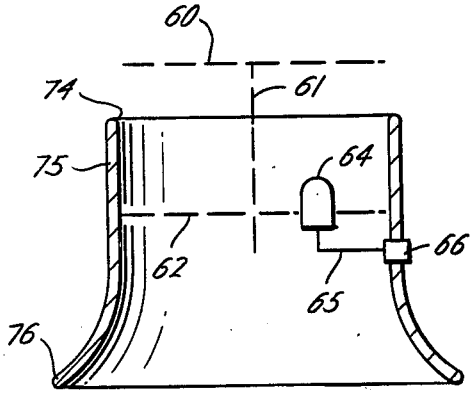
FIG. 9 is a view illustrating the invention as applied to a drum shell having a flared lower end.
Figure 10:
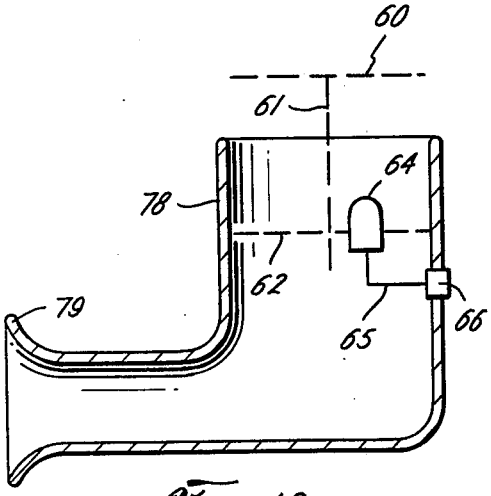
FIG. 10 is a view illustrating the invention as applied to a drum shell having a flared end and extending at a right angle to the axis of the drum.

In FIG. 8, the arrangement of FIG. 7 is illustrated with the drum head 60 positioned over the smaller end 71 of frusto-conical drum shell 72 which may optionally have a drum head at its lower end. In FIG. 9, the arrangement of FIG. 8 is shown applied to a drum shell of flared construction. Drum head 61 is supported above the open end 74 of drum shell 75 which is flared outward at its lower end 76. The lower end 76 of drum shell 75 may optionally be provided with drum head 77. In FIG. 10, drum head 60 is supported above the upper end of drum shell 78 which has a flared end portion 79 extending at a right angle to the axis of the drum shell. Flared end 79 is normally open but may optionally be provided with a drum head.

The various drum shapes shown in FIGS. 5 to 10 illustrate schematically the application of the invention as illustrated in FIG. 4 to a variety of drum shapes. These various drum shapes may also be used in the drum assemblies illustrated in FIGS. 1 and 2.

While there have been shown a variety of drum shapes supporting a drum head spaced from the open end thereof and provided with an internal microphone for amplification of the sounds from the drum it should be understood that the shapes shown are only illustrative of the invention and any other hollow drum shell of suitable drum shape may be used. As mentioned several times above, the amplification of a suitable mix of the acoustical output of the drum assembly requires that the drum head be spaced from the drum shell and the microphone positioned within the drum shell to receive both the sound directly from the drum head and the sound resonating from the walls of the drum shell. The mix of the acoustical output of the drum is a function of the position of the microphone within the drum shell and the direction in which the microphone is positioned. The microphone may be varied in position longitudinally and radially of the drum shell. If desired, the microphone may be supported adjustably to vary the position during operation. Another advantage that results from this amplified drum is that drums in a band may be isolated from other sounds (i.e., the sounds of other drums or of other instruments) in recording or broadcasting.

I claim:

1. An electro-acoustically amplified drum comprising a hollow drum shell having at least one open end, a drum head spaced from said drum shell open end and supported on said drum shell, and an acoustical microphone supported on and positioned within said drum shell and adapted to be connected to an external amplifier and speaker, said microphone being spaced from and free from any physical connection to said drum head.

2. An amplified drum according to claim 1 in which a jack is positioned in the wall of said drum shell for connection to an external amplifier and speaker, and said microphone is connected to said jack.

3. An amplified drum according to claim 1 in which said drum head comprises a cylindrical support, a drum skin stretched over said support, and a tensioning hoop surrounding said support and tightening said drum skin thereon, and means secured to said support and to the open end of said drum shell to support said drum head in spaced relation thereto.

4. An amplified drum according to claim 3 in which said securing means supports said drum head in a fixed position.

5. An amplified drum according to claim 3 in which said securing means supports said drum head adjustably in relation to the open end of said drum shell.

6. An amplified drum according to claim 3 in which said securing means comprises at least one supporting bracket.

7. An amplified drum according to claim 3 in which said securing means is an integral part of said cylindrical support and said drum shell.

8. An amplified drum according to claim 3 including a plurality of microphones positioned and supported within said drum shell.

9. An amplified drum according to claim 3 including a drum head closing the end of said drum shell opposite said open end.

10. An amplified drum according to claim 3 in which said drum shell is non-cylindrical in shape.

11. An amplified drum according to claim 10 in which said drum shell is a timpani drum shell.

12. An amplified drum according to claim 10 in which said drum shell is conical in shape.

13. An amplified drum according to claim 10 in which said drum shell is frusto-conical in shape.

14. An amplified drum according to claim 10 in which said drum shell has an outwardly flared end opposite said open end.

15. An electro-acoustically amplified drum comprising a hollow drum shell having at least one open end, a threaded supporting rod, drum head tuning means comprising a drum head including a drum skin mounted on supporting means rotatably threaded on said rod and tension means non-rotatably mounted on one end of said rod, said drum skin being stretched over said tension means, whereby rotation of said supporting means varies the tension of the drum skin to tune the the same, means operatively securing said drum head tuning means to the open end of said drum shell with said drum skin spaced from said open end, and an acoustical microphone supported on and positioned within said drum shell and adapted to be connected to an external amplifier and speaker, said microphone being spaced from and free from any physical connection to said drum head.

16. An amplified drum according to claim 15 in which said securing means is secured to the end opposite said one end of said threaded rod and supporting means are relatively adjustable to vary the spacing of said drum skin from said drum shell open end.

* * * * *